US007553267B1

(12) United States Patent
Hauser et al.

(10) Patent No.: US 7,553,267 B1
(45) Date of Patent: Jun. 30, 2009

(54) PUSH-UP EXERCISE UNIT AND DEVICE

(75) Inventors: Stephen G. Hauser, Tarzana, CA (US); Mark B. Friedman, Simi Valley, CA (US); Alden M. Mills, Kentfield, CA (US)

(73) Assignee: Perfect Pushup LLC, Mill Valley, CA (US)

( * ) Notice: Subject to any disclaimer, the term of this patent is extended or adjusted under 35 U.S.C. 154(b) by 0 days.

(21) Appl. No.: 12/253,295

(22) Filed: Oct. 17, 2008

Related U.S. Application Data

(62) Division of application No. 11/996,152, filed on Jan. 18, 2008, now Pat. No. 7,468,025.

(51) Int. Cl.
*A63B 26/00* (2006.01)
*A63B 71/00* (2006.01)

(52) U.S. Cl. ..... 482/141; 482/62; 482/910

(58) Field of Classification Search ..... 482/44–50, 482/62, 115, 135–137, 141, 146–148, 910, 482/116–118; D21/662, 665, 686; 16/DIG. 24, 16/111.1, 406, 413, 422, DIG. 25; 74/543, 74/544; 294/15, 137, 153, 167, 168
See application file for complete search history.

(56) References Cited

U.S. PATENT DOCUMENTS 574,456 A * 1/1897 Seitz ..... 16/406
2,230,989 A * 2/1941 Barish ..... 384/499
2,351,293 A * 6/1944 Saunders ..... 482/147
2,599,434 A * 6/1952 Crane ..... 16/406
3,063,714 A * 11/1962 Krauss ..... 482/147
3,100,639 A * 8/1963 Boneweitz ..... 482/147
3,115,338 A * 12/1963 Acs et al. ..... 482/141
3,454,273 A * 7/1969 Vogt ..... 482/147
3,484,894 A * 12/1969 Fletcher ..... 16/422
3,730,521 A * 5/1973 Sellman ..... 482/147
4,351,525 A * 9/1982 Rozenblad ..... 482/141
4,383,488 A * 5/1983 Macho et al. ..... 108/129
D274,411 S * 6/1984 Sidrak ..... D21/689
4,548,092 A * 10/1985 Strong, Jr. ..... 74/473.14
4,610,448 A * 9/1986 Hill ..... 482/141
4,624,276 A * 11/1986 Allen ..... 135/25.4
4,663,802 A * 5/1987 Kunzler ..... 16/408
4,768,778 A * 9/1988 Thomas, Jr. ..... 482/141
4,799,306 A * 1/1989 Collins et al. ..... 29/453
4,828,310 A * 5/1989 Schmidt et al. ..... 294/153
4,858,912 A * 8/1989 Boyd ..... 482/45
4,858,916 A * 8/1989 Beaumont ..... 482/105
4,905,540 A * 3/1990 Hughes et al. ..... 74/579 E (Continued)

*Primary Examiner*—Loan H Thanh
*Assistant Examiner*—Daniel F Roland
(74) *Attorney, Agent, or Firm*—Charter IP, LLC; Matthew J. Lattig

(57) ABSTRACT

A push-up exercise unit and device is described which may enable a user to move with his or her body's natural rotation to engage additional muscle groups with reduced stress on joints. The device includes a pair of rotatable devices, one for each hand. Each rotatable device includes a handle assembly, a rotatable handle support structure, a fixed base support, and a bearing assembly operatively attached within the handle support structure to permit rotation of the handle assembly and handle support structure. The handle assembly is removable from a top surface of the handle support structure, to be inserted into another surface of the handle support structure to configure the unit for stowage.

9 Claims, 11 Drawing Sheets

U.S. PATENT DOCUMENTS 5,084,940 A * 2/1992 Loffler et al. ..... 16/412
5,226,868 A * 7/1993 Montgomery ..... 482/141
5,256,127 A * 10/1993 Yeh ..... 482/146
5,358,463 A * 10/1994 Fuentes ..... 482/141
5,485,654 A * 1/1996 Nespodzany, Jr. ..... 16/422
5,632,707 A * 5/1997 Daniel et al. ..... 482/8
5,713,823 A * 2/1998 Walendzak et al. ..... 482/142
5,766,112 A * 6/1998 Chuan ..... 482/44
5,766,119 A * 6/1998 Clark ..... 482/146
5,845,978 A * 12/1998 Jung ..... 312/244
6,052,868 A * 4/2000 Chen ..... 16/110.1
6,101,086 A * 8/2000 Kim et al. ..... 361/683
6,129,651 A * 10/2000 Denaro ..... 482/141
6,186,930 B1 * 2/2001 Ignaczak ..... 482/141
6,443,675 B1 * 9/2002 Kopras et al. ..... 409/182
D464,095 S * 10/2002 Yu ..... D21/684
D469,831 S * 2/2003 Tuccillo ..... D21/689
6,578,236 B2 * 6/2003 Munari ..... 16/444
D523,493 S * 6/2006 Horton ..... D21/662
7,063,646 B1 * 6/2006 Slimi ..... 482/45
7,238,147 B2 * 7/2007 Mills et al. ..... 482/106
7,377,888 B2 * 5/2008 Godbold ..... 482/141
D576,693 S * 9/2008 Khubani ..... D21/686
7,424,768 B2 * 9/2008 Beruscha et al. ..... 16/422
D579,503 S * 10/2008 Hauser et al. ..... D21/662
D580,998 S * 11/2008 Lin ..... D21/686
7,503,884 B1 * 3/2009 Schall ..... 482/141
2002/0032952 A1 * 3/2002 Munari ..... 16/406
2003/0216221 A1 * 11/2003 Iverson ..... 482/51
2004/0266593 A1 * 12/2004 Schwendeman ..... 482/140
2005/0003931 A1 * 1/2005 Mills et al. ..... 482/5
2005/0227831 A1 * 10/2005 Mills et al. ..... 482/106
2006/0014615 A1 * 1/2006 Godbold ..... 482/141
2006/0035771 A1 * 2/2006 Gant ..... 482/141
2006/0040809 A1 * 2/2006 Godbold ..... 482/141
2007/0184951 A1 * 8/2007 James et al. ..... 482/141

* cited by examiner

PUSH-UP EXERCISE UNIT AND DEVICE

PRIORITY STATEMENT

This application is a divisional of and claims the benefit under 35 U.S.C. §120 of U.S. patent application Ser. No. 11/996,152 to Stephen G. Hauser, et al., filed Jan. 18, 2008 and entitled "PUSH-UP EXERCISE UNIT AND DEVICE", now U.S. Pat. No. 7,468,025. The entirety of the contents of the '152 application are hereby incorporated by reference herein.

BACKGROUND

Example embodiments in general relate to a push-up exercise unit and device for use in performing a push-up type exercise.

Push-ups are one of the oldest and perhaps most effective exercises for a human being. The push-up exercise is employed by the military and competitive sports teams around the world to gauge overall fitness. Conventional push-ups however, with the hands placed directly on a non-movable hard surface such as a floor, have limitations. Conventional push-ups place stress on wrists, elbows and shoulders, and prevent the natural rotation of muscles and joints.

SUMMARY

An example embodiment of the present invention is directed to a push-up exercise unit and device. The device includes a pair of rotatable devices, one for each hand. Each rotatable device includes a handle assembly, a rotatable handle support structure, a fixed base support, and a bearing assembly operatively attached within the handle support structure to permit rotation of the handle assembly and handle support structure. The handle assembly is removable from a top surface of the handle support structure, to be inserted into another surface of the handle support structure to configure the unit for stowage.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION OF EXAMPLE EMBODIMENTS

Figure 1:
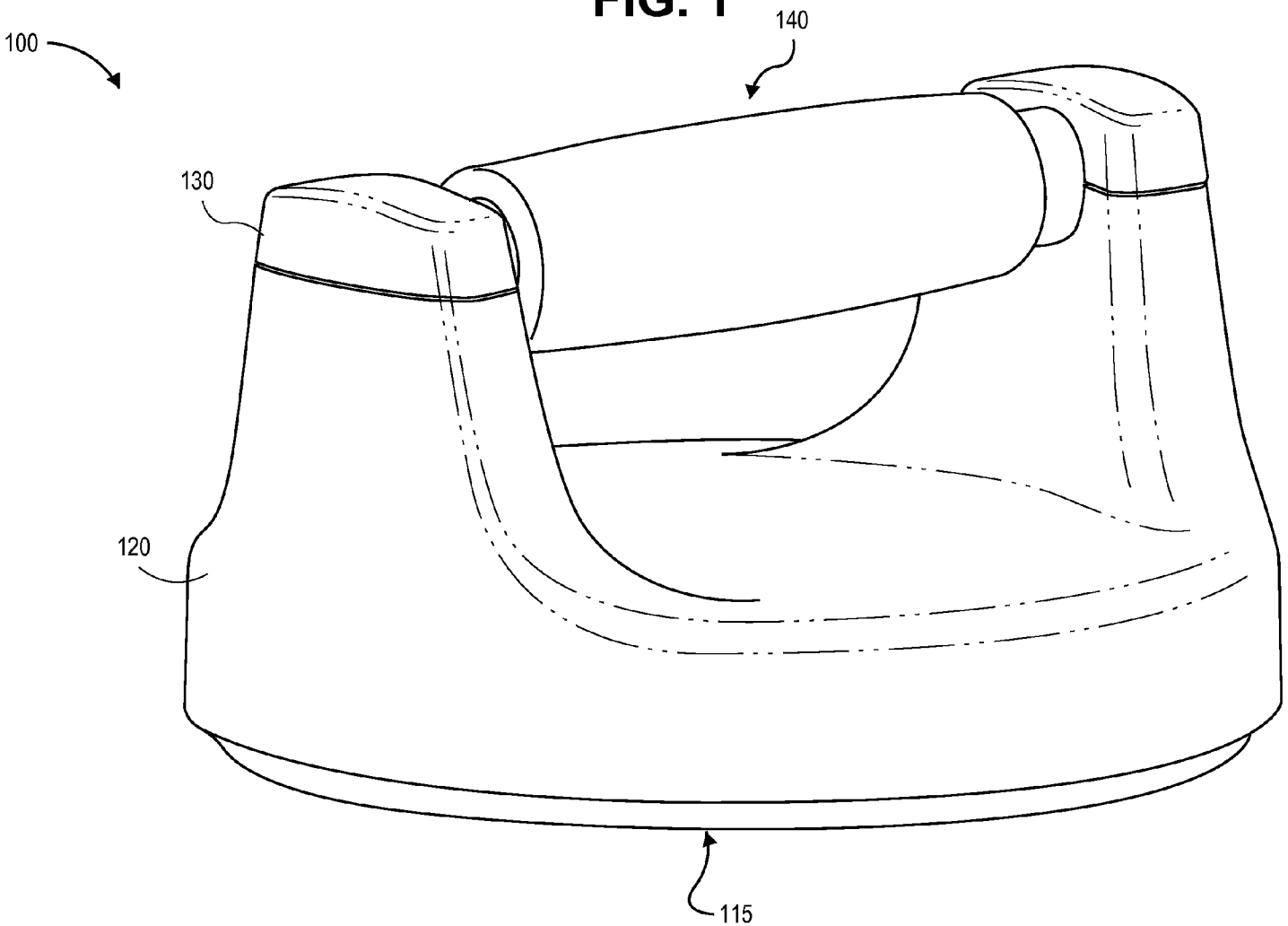
FIG. 1 is perspective view of one exercise device 100 of a pair of devices which comprise a push-up unit, in accordance with an example embodiment.

FIG. 1 is perspective view of one exercise device 100 of a pair of exercise devices which comprise a push-up unit, in accordance with an example embodiment. Referring to FIG. 1, a singular push-up device, hereafter 'device 100' includes a base support 115 which is immediately connected to a main handle support structure 120 via a plurality of interior fasteners such as screws. In practice, a complete push-up unit includes a pair of devices 100, one for each hand, as is known. In each device 100, the handle support structure 120 is operatively connected to a pair of end caps 130. A handle assembly 140 is provided in a cavity or circular aperture formed between the intersections of the end caps 130 and the handle support structure 120.

In general, the housing of device 100, inclusive of base support 115, handle support structure 120 and the separate end caps 130, can be formed by an injection molding process from a medium or heavy gauge impact plastic such as acrylonitrile butadiene styrene (ABS). ABS is an easily machined, tough, low-cost, rigid thermoplastic material with medium to high impact strength, and is a desirable material for turning, drilling, sawing, die-cutting, shearing, etc.

Each of the base support 115, main handle support structure 120 and end caps 130 may be made of ABS. ABS is merely one example material; equivalent materials include various thermoplastic and thermoset materials that have characteristics similar to ABS. For example, polypropylene, high-strength polycarbonates such as GE Lexan, and/or blended plastics may be used instead of, or in addition with ABS. The materials comprising device 100 (plastic such as ABS, rubber and lightweight metal materials) provide a light yet durable exercise device 100.

An exemplary injection molding system for forming molded plastic articles included in device 100 may be the Roboshot® injection machine from Milacron-Fanuc. The Roboshot is one of many known injection molding machines for forming plastic injection molds.

Figure 2:
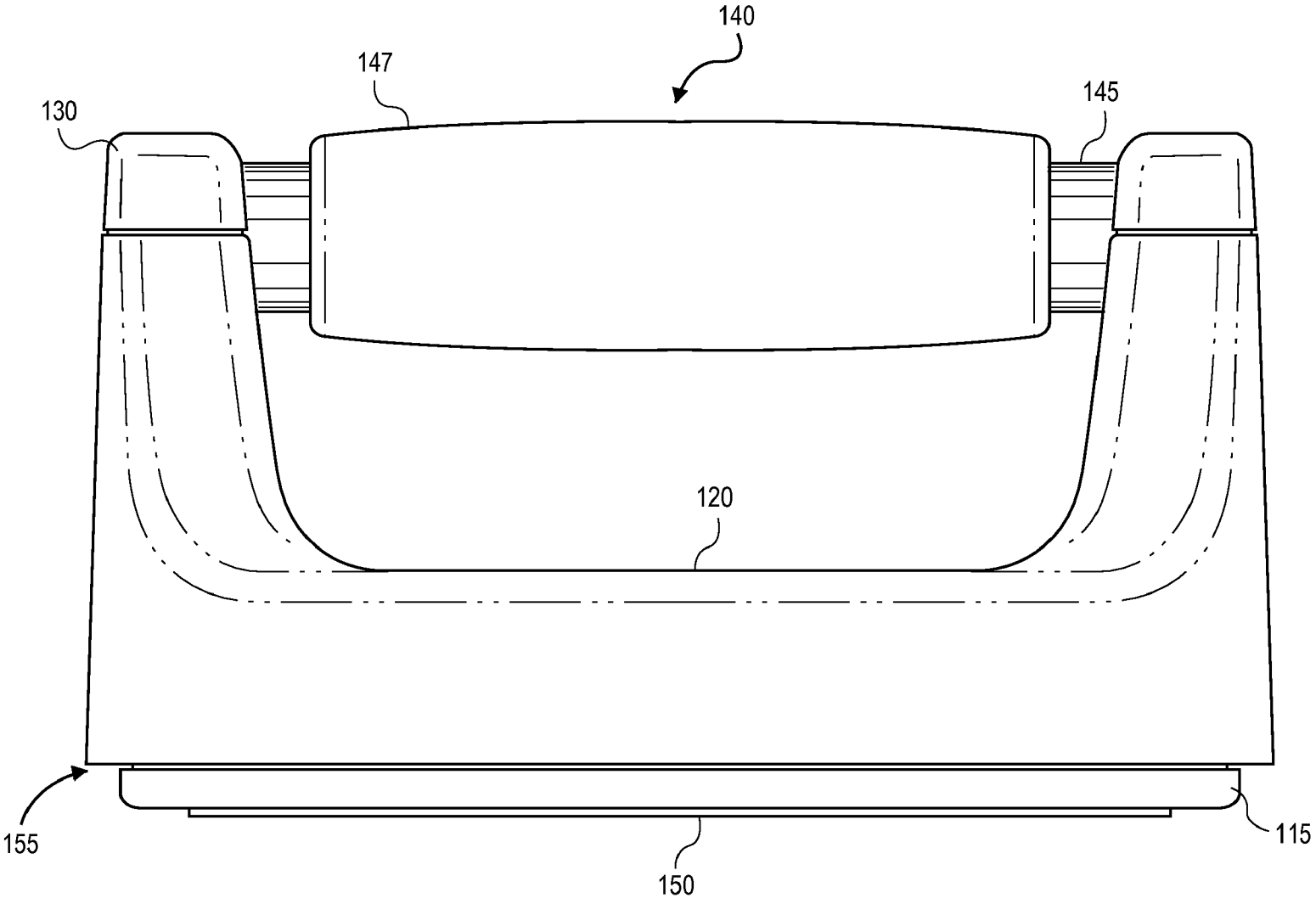
FIG. 2 is a front view of the device 100.

FIG. 2 is a front view of the device 100. Device 100 includes a handle assembly 140. The handle assembly 140 comprises a chrome steel handle-rod 145 overlaid with or sheathed within a grip 147. The handle-rod 145 may alternatively be comprised of an aluminum hollow member and is received within corresponding recesses (not shown) formed in the end caps 130 and handle support structure 120 which, when aligned, form a circular aperture around each handle end. The grip 147 may be made of a foam rubber or suitable elastomeric material and has a wider or thicker center portion which tapers down to the end portions of grip 147.

Device 100 includes a solid rubber gripping surface configured as a rubberized pad 150. Pad 150 is provided on the underside of the base support 115. The pad 150 offers a friction surface when the device 100 is resting on a flat surface. The pad 150 may be adhered to the underside of the base support 115 via suitable epoxy or adhesive, for example. The non-skid rubber pad 150 grips well on carpet and hard floor surfaces.

A gap 155 is provided between the handle support structure 120 and the base support 115 to assist in permitting rotational movement of the contiguous handle support structure 120 with end caps 130 and handle assembly 140, ostensibly by providing clearance for a bearing assembly, while the base support 115 remains fixed in place. In this example, the rotational movement is facilitated by a turntable or "Lazy Susan" bearing assembly within the device 100, which is interposed between the main handle support structure 120 and base support 115. Thus, the gap 155 provided between the housing of the handle support structure 120 and base support 115 permits collective rotational movement of the contiguous upper portion of the device 100: handle support structure 120, end caps 130 and handle assembly 140.

Figure 3:
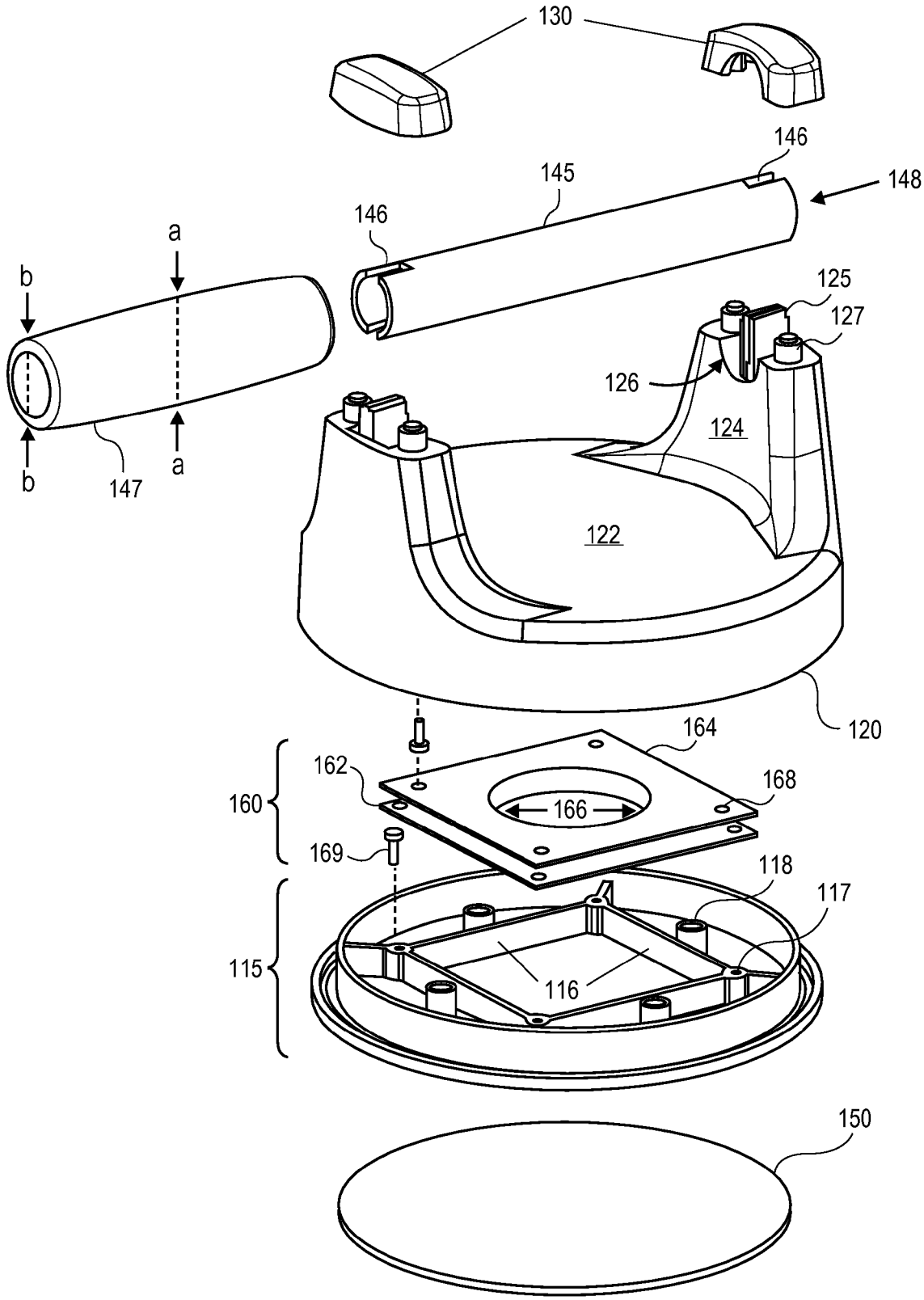
FIG. 3 is an exploded view of the device 100 to illustrate constituent components thereof in greater detail.

FIG. 3 is an exploded view of the device 100. As shown in FIG. 3, the handle assembly 140 includes the elongated handle-rod 145 which has chamfers 146 at ends thereof. The handle-rod 145 is hollow as shown by arrow 148. In an example, the width "a" at central portion of the grip 147 is wider or thicker at a diameter thereof then width "b" at ends thereof. This is to better conform to the user's hand to facilitate grasping the handle assembly 140 of the device 100.

FIG. 3 also illustrates the handle support structure 120 in further detail. For purposes of clarity, the end caps 130 in FIG. 3 have been removed. The handle support structure 120 includes lower base 122 and two formed columns 124 which slope upward from the lower base 122. A recess 126 having a generally semi-circular surface is formed in each column 124. In each column 124, a stanchion 125 is located generally in the center of its corresponding recess 126 for mating engagement with the chamfers 146 of the handle-rod 145. The top portion of each column 124 includes a pair of posts 127 for mating engagement within corresponding bores (not shown, characterized as crevices within the underside of the end caps 130).

With continued reference to FIG. 3, the device 100 includes a steel or hard plastic ball-bearing rotational system. In an example, this system may be embodied as a turntable to allow rotation of movement of device 100. In particular, the turntable permits rotation between the upper portion of the device 100 and the base support 115.

Referring to FIG. 3, there is shown a square "Lazy Susan" turntable 160. The turntable 160 comprises two connected parts, a lower fixed plate 162 and an upper rotatable plate 164. A bearing assembly, indicated generally by arrows 166 surrounding a race (center circumferential opening) within the turntable 160 is provided between the lower fixed plate 162 and upper rotatable plate 164. These bearings are not shown for purposes of clarity.

In an example, the turntable 160 may be made of lightweight stamped aluminum plates with stainless steel ball bearings therein. For example, the turntable may be a 6"×6" square turntable fabricated by McMaster-Carr, part number 6031K18. However, the example embodiments are not limited to aluminum turntable plates, as galvanized steel, black chromate and yellow chromate are also acceptable materials for the turntable.

With continued reference to FIG. 3, the base support 115 includes an interior structure shown as a molded element 116. Molded element 116 includes a bore hole 117 at each corner thereof for receiving suitable fasteners 169 such as self-tapping screws which connect lower fixed plate 162 of the turntable 160 to the base support 115. The base support 115 includes a plurality of spacers 118 for clearance and hence to generate the gap 155 between the base support 115 and handle support structure 120. A plurality of bores 168 are formed through both the lower fixed plate 162 and upper plate 164 to enable fasteners 169 to engage an underside of the handle support structure 120, enabling the upper portion of device 100 to rotate as a contiguous unit with the upper plate 164.

Figure 4A:
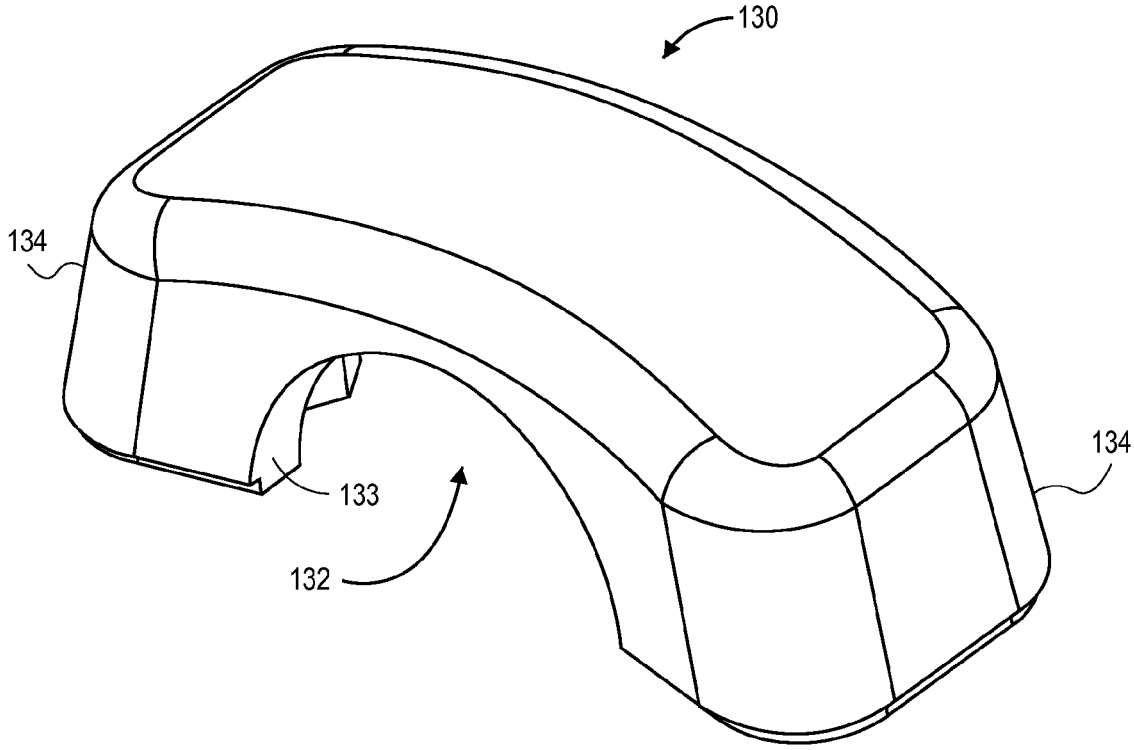
FIG. 4A is a perspective view of the end cap 130.
Figure 4B:
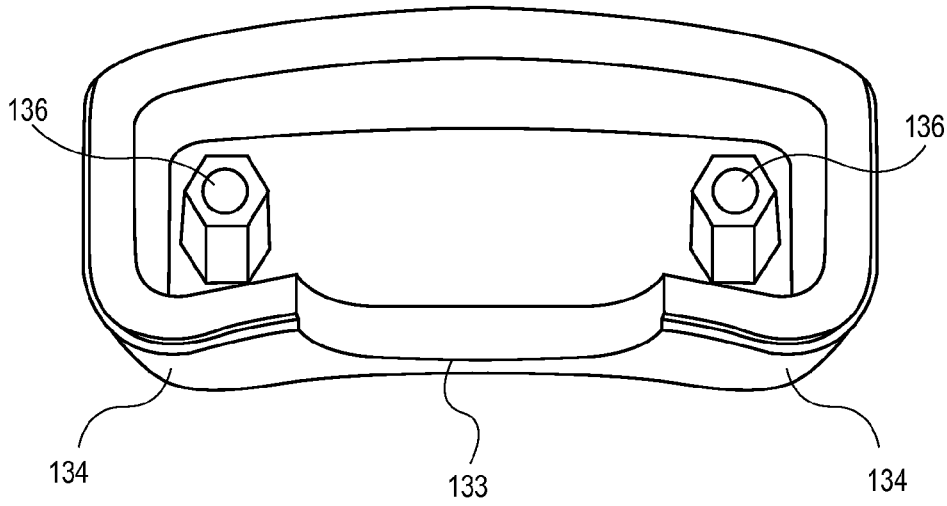
FIG. 4B is an interior view of the end cap 130.
Figure 5:
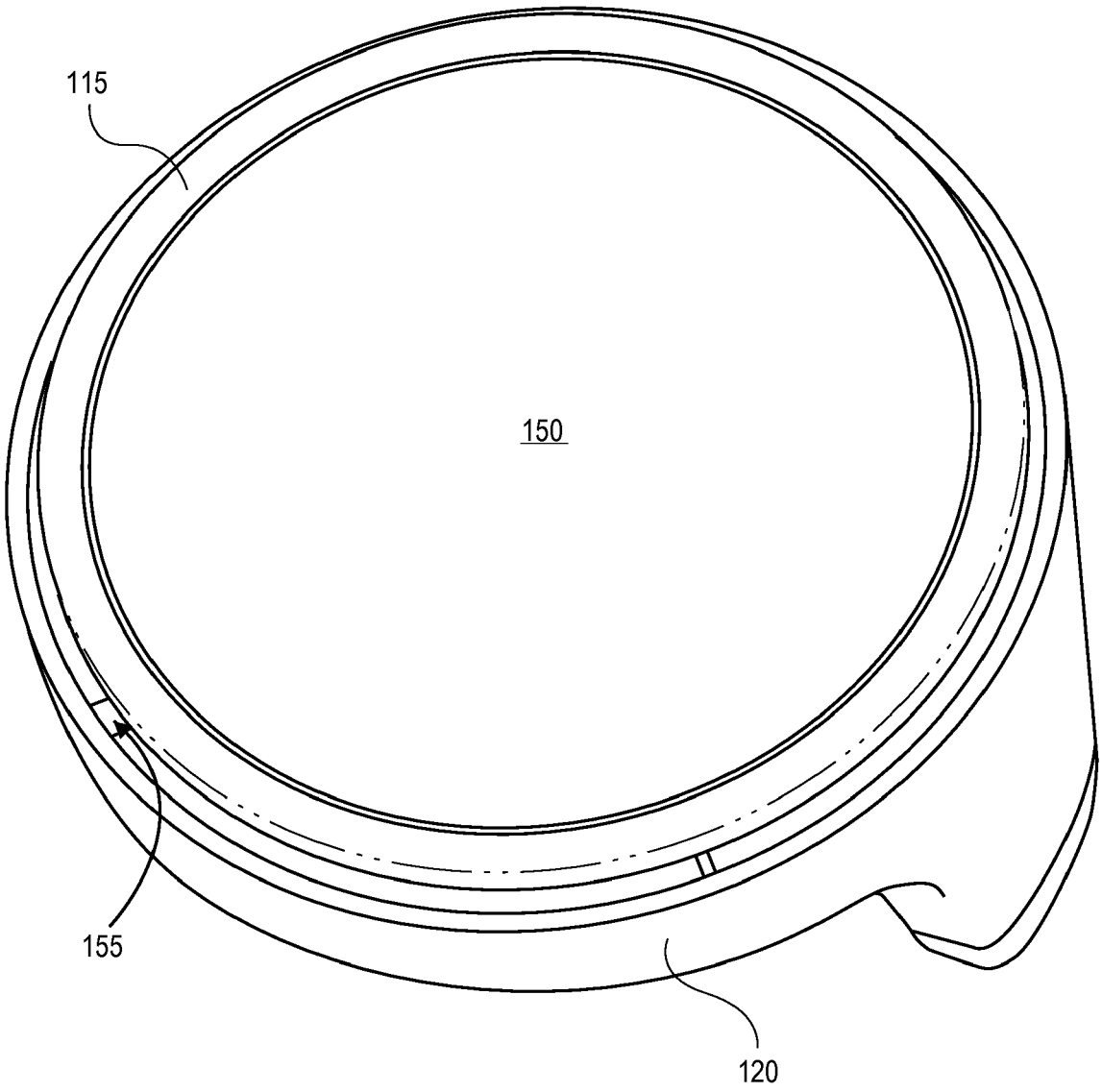
FIG. 5 is an underside view of the device 100 to illustrate the rubberized pad 150 in further detail.

FIG. 4A is a perspective view of the end cap 130; FIG. 4B is an interior view of the end cap 130. Each end cap 130 has a semi-circular arc 132 provided by recess 133 at a central grasping portion thereof and extends down to a pair of columns 134 which minimally engage the columns 124 of the handle support structure 120 via the posts 127 and interior bores 136 within the underside of end cap 130. As can also be seen in FIG. 4B, the semi-circular recess 133 on the interior underside of each end cap 130, when connected to the columns 124 of the handle support structure 120, forms the circular opening for receiving the handle-rod 145. As best shown in FIG. 4B, the bores 136 receive the posts 127 from the handle support structure 120 as previously shown in FIG. 3, for example.

Use of device 100 may benefit a workout by imparting rotational movement to force various hand/shoulder orientations, enabling the user to exercise different parts of the arms and shoulders, as well as the upper and lower back. The revolving turntable 160 provides clean rotational movement, since the ball bearings housed in a generally large circular race have a space saving design which is approximately only about 5/16" high. As an alternative, notches or detents could be provided on the outer circumferential surface of the rotating plate of the turntable 160 to give a repeatable position capability to the user of the device 100.

The example device 100 allows the user's arms to rotate naturally during the push-up in much the same way as when the user throws a punch or presses up a dumbbell. This accelerates results by engaging more muscles and reducing strain on the joints—potentially maximizing the user's workout. The rotating base supports 115 thus permit the user's muscles to rotate through its natural arc. Examples of such natural arc of movement include throwing a punch, swinging a golf club or pressing dumbbells, for example.

Accordingly, the incorporation of the smooth, ball bearing action of the handle assemblies 140/handle support structure 120 on the non-skid base support 115 facilitate the user's workout on any hard floor surface or carpet. The example device 100 may thus enable the user to move with his or her body's natural rotation, so as to engage additional muscle groups with reduced stress on the user's joints, as compared to the conventional push-up exercise.

Figure 6:
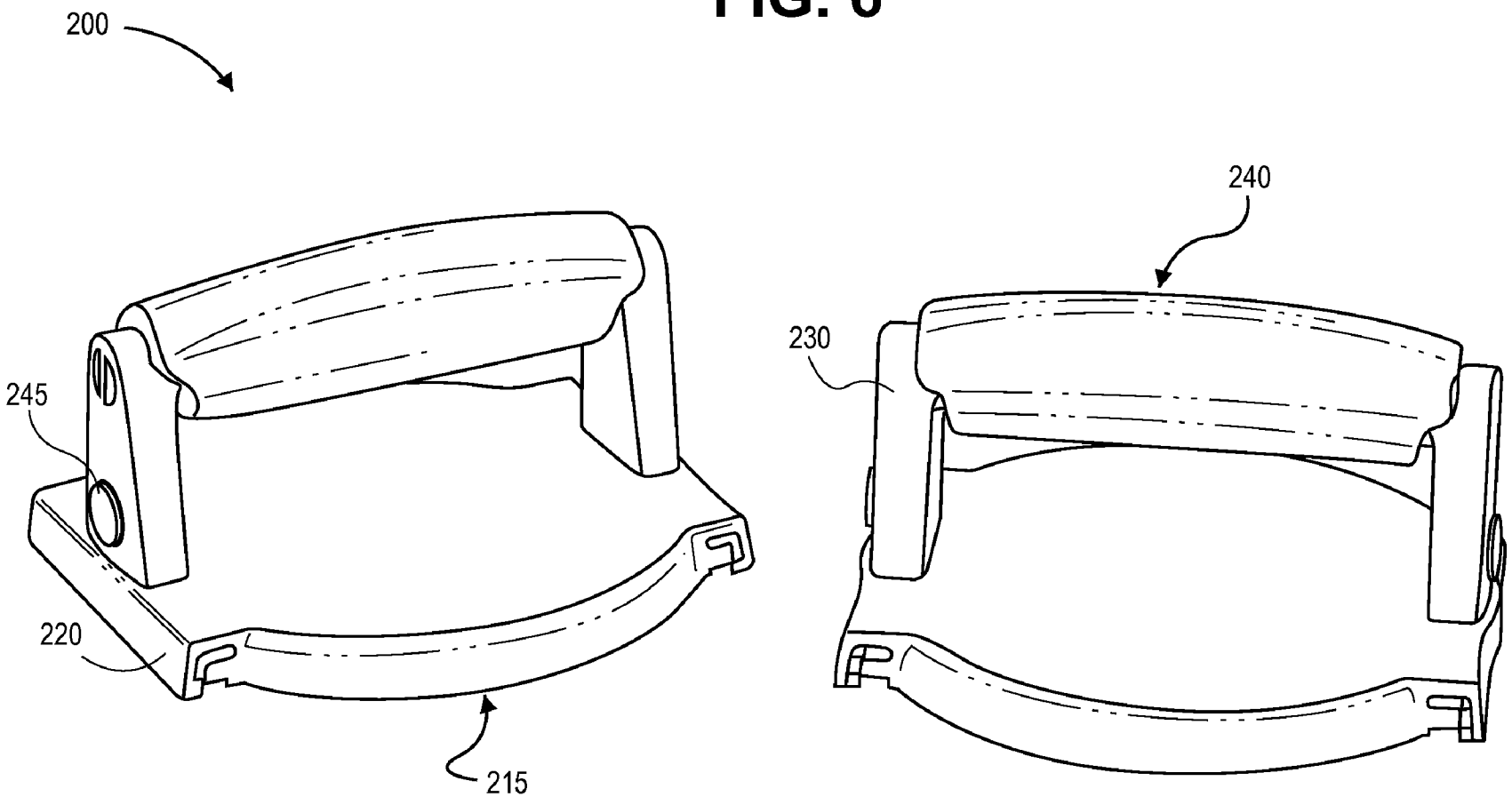
FIG. 6 is perspective view of an exercise device 200 in accordance with another example embodiment.

FIG. 6 is perspective view of an exercise device 200 in accordance with another example embodiment. Device 200, shown as a pair ("push-up unit"), is similar to device 100 as shown in FIGS. 1-5; thus only the differences will be described in detail hereafter for sake of brevity. Each device 200 includes a handle assembly 210 comprising a handle 240 attached between a pair of support arms 230. The handle 240 may be fabricated from a solid rod of steel, aluminum or plastic, for example.

Each of the base support 215, handle support structure 220 and support arms 230 may be made of ABS or another thermoplastic and/or thermoset material having characteristics similar to ABS, such as polypropylene, high-strength polycarbonates such as GE Lexan, and/or blended plastics. These equivalent materials can be used in lieu of or in addition to ABS. The handle 240 may be a steel or chrome rod sheathed with a suitable rubber or plastic grip. The handle support structure 220 envelops a base support 215. The fixed base support 215 has a non-skid pad 250 on an underside thereof, similar to device 100.

Unlike device 100, each handle assembly 210 is readily detachable via a release mechanism 245 from its corresponding handle support structure 220 at a first location on an lower base 222 thereof, to be re-attached at a second location on the push-up unit so as to couple the two base supports 215 together as a tight package formed within the two base support structures 220, which mate with each other and which are secured by a locking action of the two handle assemblies 210 into the front and rear facings 225 of each handle support structure 220.

Figure 7A:
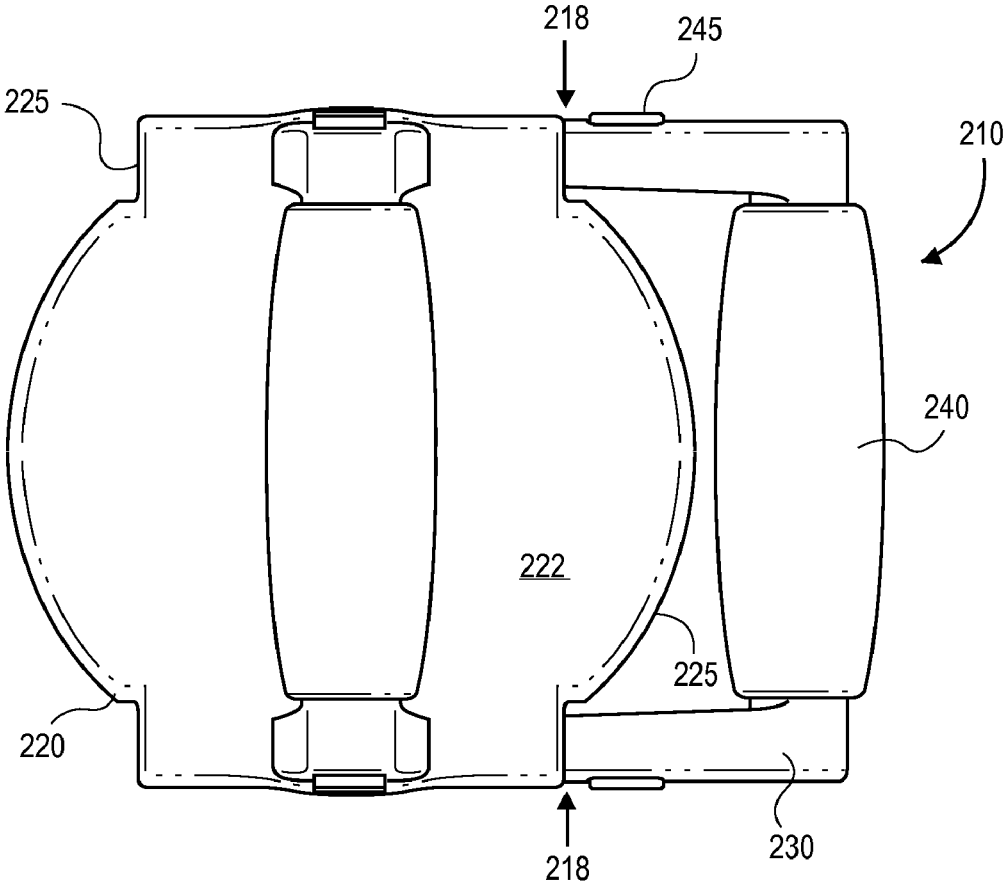
FIG. 7A is a top view showing how a handle 240 is configured in preparation for storage.
Figure 7B:
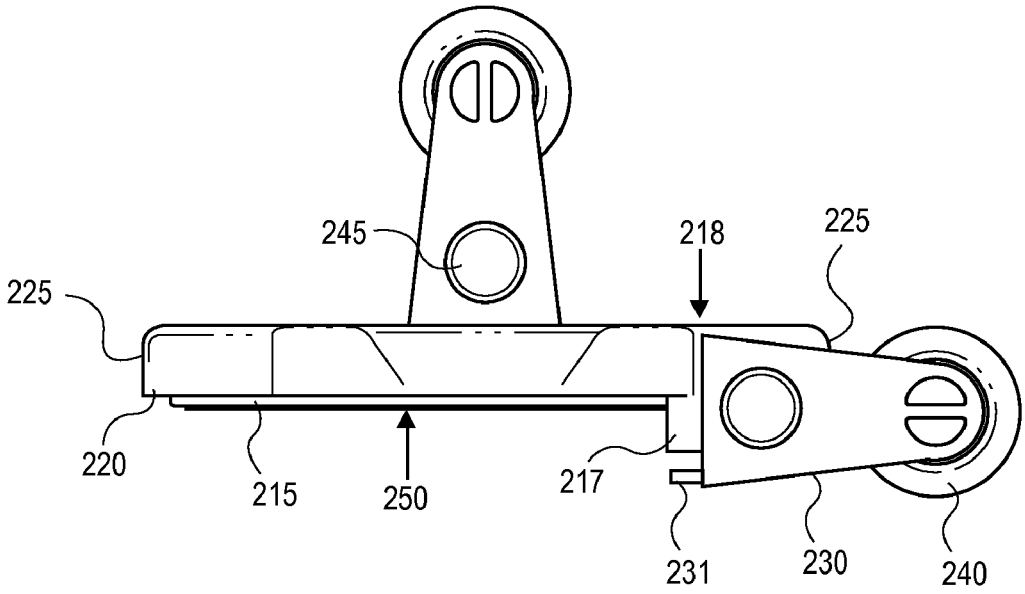
FIG. 7B is a side view of FIG. 7A to show the relation of the handle assembly 210 to the base support 215 in further detail.

FIG. 7A is a top view showing how a handle 240 is configured in preparation for storage; FIG. 7B is a side view of FIG. 7A to show the relation of the handle assembly 210 to the base support 215 in further detail. For purposes of clarity, the handle support structure 220 of one device 200 of the pair has been removed to better show the interconnection of a handle assembly 210 from a front or rear facing 225 of a given handle support structure 220. In particular, once removed from the lower base 222 of its corresponding handle support structure 220 by depressing the release mechanism, each support arm 230 of the handle assembly is inserted into corresponding slots at a junction 218. Each support arm 230 on the handle assembly includes a locking lug 217 which engages a corresponding slot (not shown) in the front or rear facing of the handle support structure 220 to enable a snap fit.

Figure 8A:
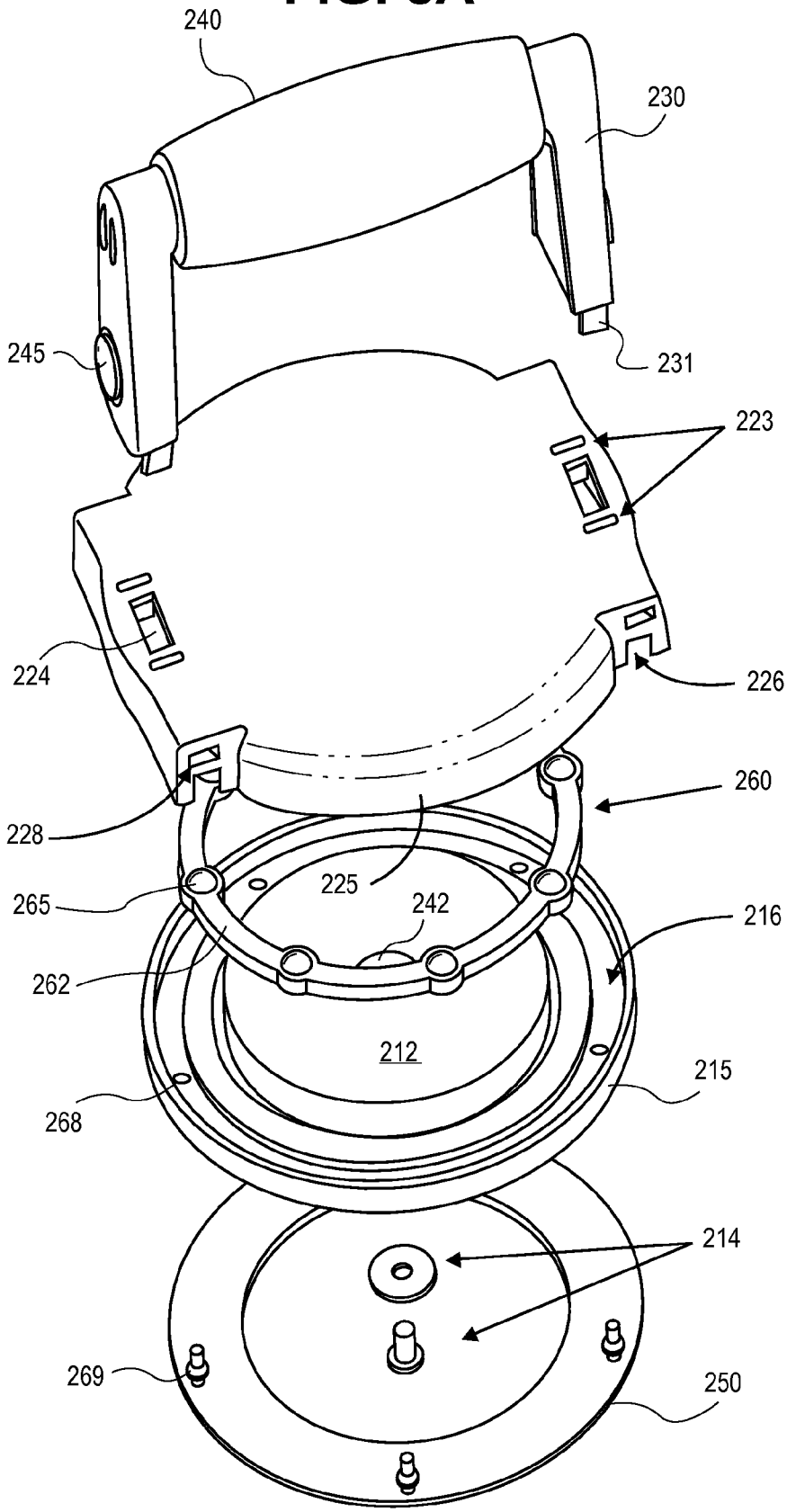
FIG. 8A is an exploded view of one device 200 of the pair to illustrate constituent components thereof in greater detail.

FIG. 8A is an exploded view of one device 200 of the pair to illustrate constituent components thereof in greater detail. Only one base support 215 and handle support structure 220 is shown, it being understood that in its stowed configuration, the two base supports 215 are sandwiched between the base support structures 220 which are locked together by the pair of handle assemblies 210. To assemble a given device 200, a handle assembly 210 is removed from the front or rear facings 225 of the base support structures 220. In particular, the user depresses both release mechanisms 245 to release the corresponding locking lugs 217 from the locking slots 226 formed in the facings 225 of the support structures 220, when the two base support structures are in a mating relationship to enclose the facing base supports 215.

As can be seen in FIG. 8A, each of the support arms 230 includes a central locking lug 217 arranged between two foot members 231. The handle assembly 210, once removed from the facings 223, then snaps into the lower base 222 of its corresponding handle support structure 220. In particular, the locking lug 217 engages a top locking slot 224 and the two feet 231 align with slots 223 so as to properly orient the handle assembly 210 on the lower base 222 of the handle support structure 220. This results in a secure snap fit, such that a lip of the lug 217 secures the support arm 230 within locking slot 224.

With continued reference to FIG. 8A, each device 200 includes a steel or hard plastic ball-bearing rotational system somewhat similar to that shown in FIG. 3, so to permit rotation between the upper portion of the device 200 and the base support 215. This system 260 includes a bearing ring or race 262 supporting a plurality of glass bearings 265 configured in spaced relation around a circumference thereof. The ball-bearing rotational system 260 is supported within a circular channel 216 of base support 215 around a center post 212 of the base support 215. The base support 215 includes a plurality of bores 268 which receive fasteners 269 extending from a rubber ring pad 250'. The center post 212 has a central aperture 242 to receive fastening elements 214 which fasten the fixed base support 215 to the rotating contiguous handle support structure 220 and handle assembly 210 of the device 200. The rubber ring pad 250' is adhered to the bottom of base support 215 to provide a friction surface.

Figure 8B:
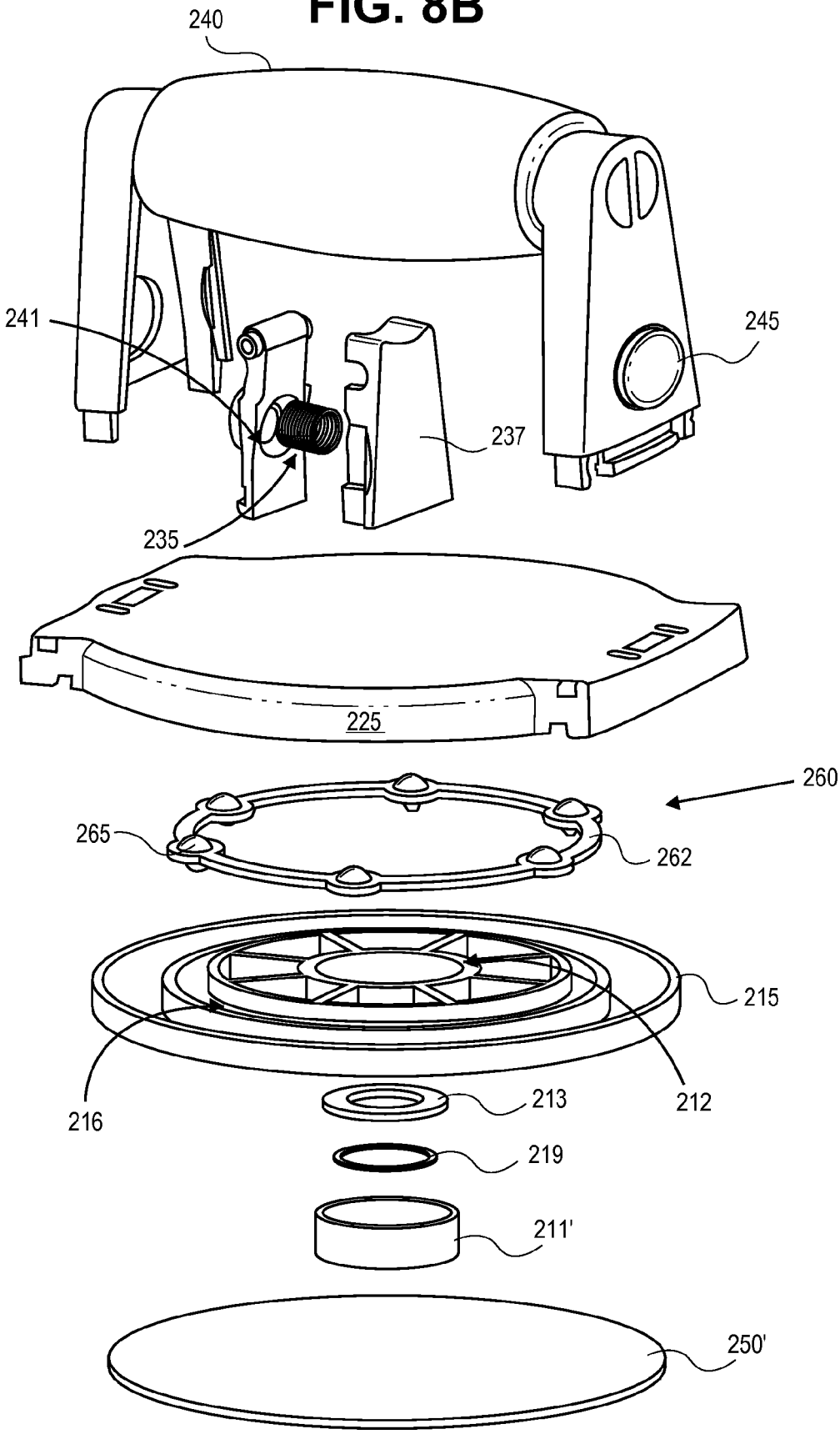
FIG. 8B illustrates an alternative construction of the lower portion of device 200.

FIG. 8B illustrates an alternative construction of the lower portion of device 200, only the differences from FIG. 8A are described in detail. In FIG. 8B, the bearing race 262 containing glass bearings 265 seats in channel 216 of base support 215. However, instead of a rubber ring pad 250' adhered to the underside of base support 215, and the fastening means 214 (screw/washer) connected base support 250 to handle support structure 220 via a bore through center post 212, the example of FIG. 8B employs a full size rubber ring pad 250' attached to the bottom of base support 215 with adhesive. There is also a washer 213 and a retainer ring 219 enclosed by a fixed cap 211 which seats within the interior of the center post 212.

Figure 9:
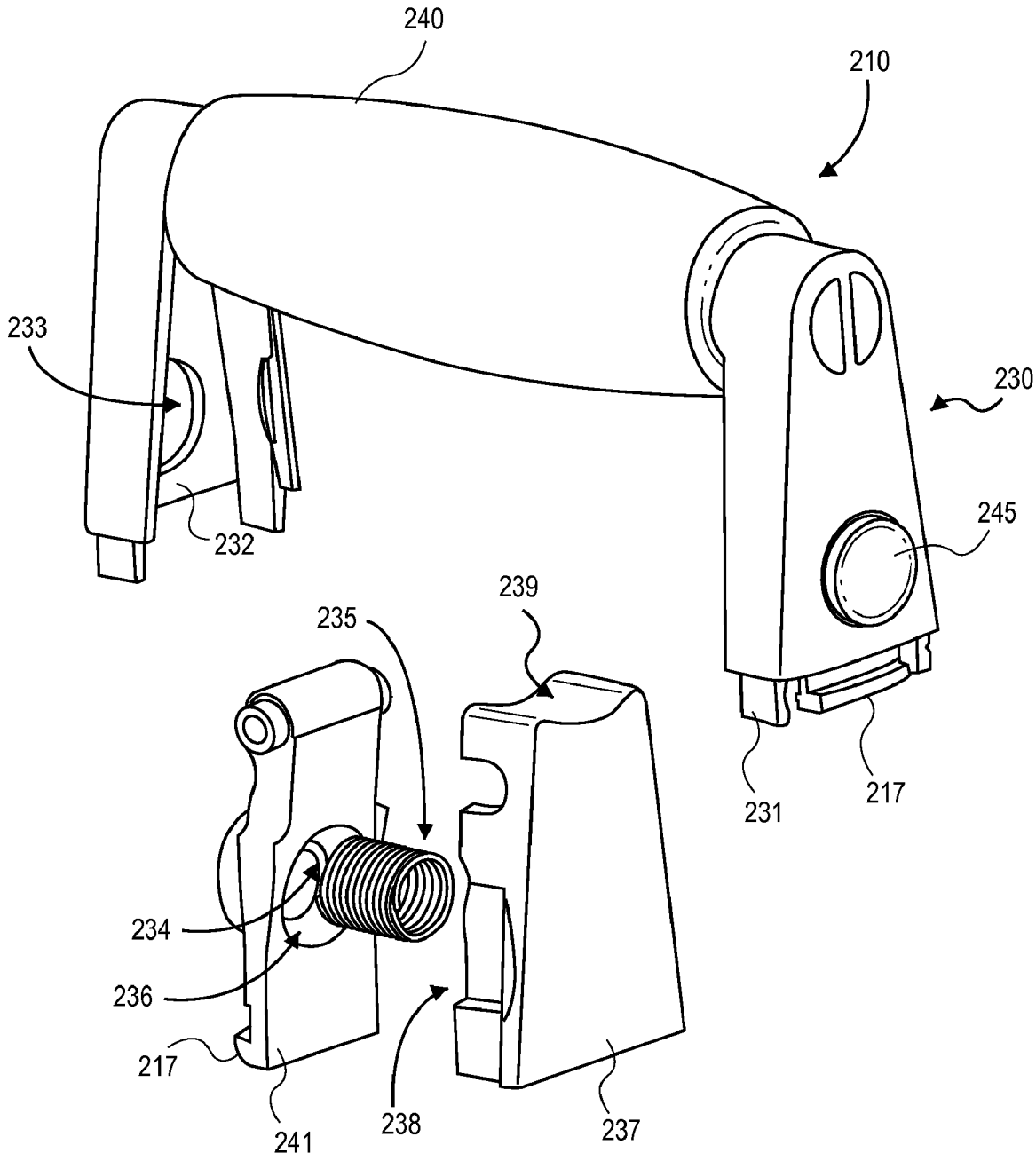
FIG. 9 is a partial exploded view of the handle 240 and support arm 230 of the handle assembly 210 to further detail the components comprising the release mechanism 245.

FIG. 9 is a partial view of the handle 240 and support arm 230 of the handle assembly 210 to further describe components comprising the release mechanism 245. Each support arm 230 includes an outer sidewall 232 having an aperture there through to receive the release mechanism 245, which is shown as a spring actuated button 245. Each support arm 230 terminates from its apex to its bottom into two feet 231 to be received in one of slots 223 in the lower base 222 of the handle support structure 220, or into slots 228 on the facings 225 of the front or rear of the handle support structure 220 if the push-up unit is to be configured for stowage.

Each support arm 230 includes a central member 241 between the outer sidewall 232 and an inner sidewall 237. The central member 241 has an aperture 236 which aligns with aperture 233 in the outer sidewall 232 so as to receive a post 234 of the release mechanism 245. The post 234 contacts a compression spring 235 to compress the spring 235 against a counter force provided by the wall surface (shown generally at 238) of the inner sidewall 237. The central member 241 terminates at its lower end as the locking lug 217. The top surface 239 of inner sidewall 237 is shaped so as to mate flush with the rounded outer surface of handle 240.

Figure 10:
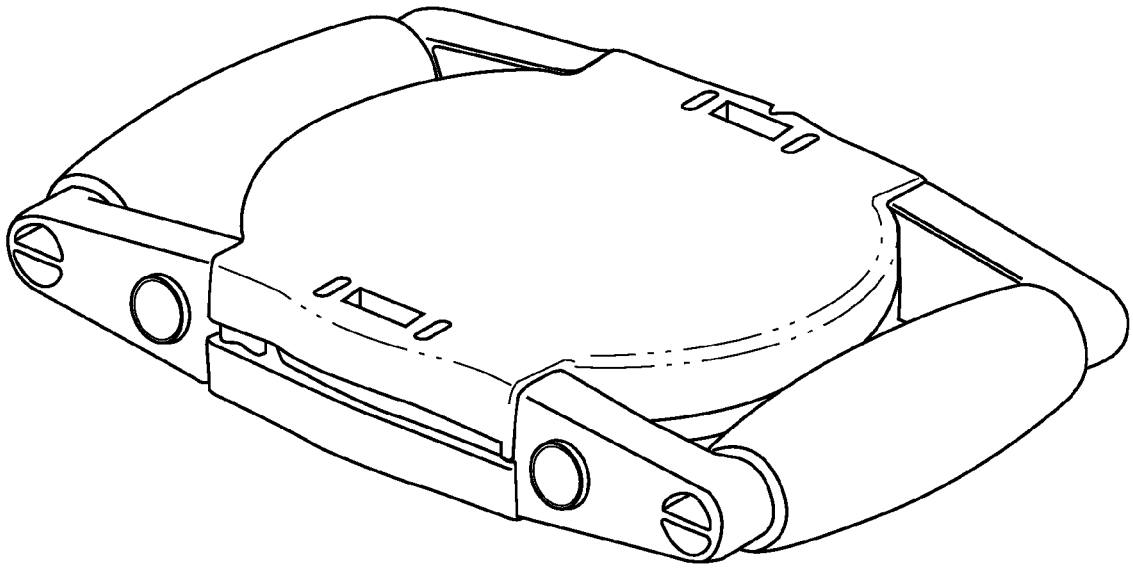
FIG. 10 is a perspective view of the complete push-up unit configured for stowage.

FIG. 10 is a perspective view of the complete push-up unit configured for stowage. As shown, the generally flat, compact design enables the unit to be stowed for travel, for example. The two handle assemblies 210 interconnect between the facing base support structures 220 so as to secure the base support structures 220 and corresponding base supports 215 together. The push-up exercise unit comprising devices 200 thus provides a small, lightweight embodiment that can be disassembled and stowed for travel. This enables the user to more easily store and transport the unit when going on trips.

The example embodiments being thus described, it will be obvious that the same may be varied in many ways. For example, the bearing systems in FIGS. 3 and 8 can be interchangeable between devices 100, 200. Further, instead of forming separate end caps 130 and handle support structure 120, the housing could be a single molded article. Such variations are not to be regarded as departure from the example embodiments, and all such modifications as would be obvious to one skilled in the art are intended to be included herein.

What is claimed:

1. A push-up exercise unit, comprising:

a pair of rotatable devices, one for each hand, each device including:

a handle assembly, a rotatable handle support structure having a pair of spaced cavity slots formed in a front and a rear side, a fixed base support attached to the handle support structure, and a bearing assembly operatively attached within the handle support structure to permit rotation of the handle assembly and handle support structure on the base support, wherein each handle assembly is removed from a top surface of the handle support structure, the two handle support structures are placed together so that the base supports contact each other, and each handle assembly is inserted into a corresponding pair of the formed cavity slots of the front and rear sides to sandwich the base supports between the handle support structures in a snap-fit locked position and configure the unit for stowage.

2. The unit of claim 1, wherein the handle assembly includes a pair of support arms which support the handle, each support arm having a locking lug at a lower end thereof, and the top surface includes a plurality of slots for releasably securing the locking lugs therein.

3. The unit of claim 2, further comprising a release mechanism provided in each support arm, the release mechanism actuated to detach the locking lugs from the slots on the handle assembly top surface for insertion of the locking lugs into the cavity slots formed in the facing handle support structures of the two devices.

4. A push-up exercise device, comprising:

a handle assembly, a rotatable handle support structure having a top horizontal surface and a downwardly extending vertical facing around a circumference thereof, the vertical facing having a front side with a pair of spaced slots and a rear side with a pair of spaced slots, a fixed base support attached to the handle support structure, and a bearing assembly operatively attached within the handle support structure to permit rotation of the handle assembly and handle support structure, the handle assembly being removed from the top surface of the handle support structure and configured to be inserted sideways into the spaced slots of either the front side or rear side of the vertical facing.

5. The device of claim 4, wherein the handle assembly includes a pair of support arms which support the handle, each support arm having a locking lug at a lower end thereof, and the top surface includes a plurality of slots for releasably securing the locking lugs therein.

6. The device of claim 5, further comprising a release mechanism provided in each support arm, the release mechanism actuated to detach the locking lugs from the slots on the top surface for insertion of the locking lugs into the spaced slots of either the front side or rear side of the vertical facing.

7. A push-up exercise unit, comprising:

a pair of rotatable devices, one for each hand, each device including:

a handle, a handle support structure having gaps formed in a front and a rear side, a fixed base support attached to the handle support structure, and a bearing assembly operatively attached within the handle support structure to permit rotation of the handle and handle support structure on the base support, wherein to configure the unit for stowage, the handles are removed, the handle support structures are placed together so that the base supports contact each other in facing relation, and the handles are inserted into the gaps formed in the front and rear sides of the facing handle support structures.

8. The unit of claim 7, wherein upon removal the handle are rotated approximately 90 degrees from an installed position on top of the handle support structures for sideways insertion into the front and rear sides of the facing handle support structures.

9. The unit of claim 7, wherein in its stowed configuration, the facing handles support structures with base supports are connected between the two handles in the same horizontal plane, so that the unit lies flat on a horizontal surface.

* * * * *

UNITED STATES PATENT AND TRADEMARK OFFICE

CERTIFICATE OF CORRECTION

PATENT NO. : 7,553,267 B1
APPLICATION NO. : 12/253295
DATED : October 17, 2008
INVENTOR(S) : Hauser et al.

It is certified that error appears in the above-identified patent and that said Letters Patent is hereby corrected as shown below:

Column 1, lines 49, 59: "is perspective view" should read --is a perspective view--

Column 2, line 13: "is perspective view" should read --is a perspective view--; line 33: "each of the base support, handle support structure, and end caps" should read --each base support, handle support structure, and end cap--; line 39: "may be used instead of, or in addition with ABS" should read --may be used instead of or in addition with ABS--; line 49: "front view of the device 100" should read --front view of device 100--

Column 4, line 35: "Examples of such natural arc of movement include throwing a punch, swinging a golf club or pressing dumbbells, for example." should read --Examples of such natural arcs of movement include throwing a punch, swinging a golf club or pressing dumbbells.--; line 46: "is perspective view" should read --is a perspective view--; line 50: "for sake of brevity" should read --for the sake of brevity--; line 55: "each of the base support 215, handle support structure 220 and support arms 230" should read --Each base support 215, handle support structure 220, and support arm 230--

Column 5, line 1: "an lower base" should read --a lower base--; line 41: "facings 223" should read --facings 225--

Column 6, line 19: "to be received in one of slots 223" should read --to be received in one of the slots 223--; line 43: "to more easily store and transport the unit" should read --to store and transport the unit more easily--

Signed and Sealed this

Twenty-first Day of December, 2010

David J. Kappos

David J. Kappos
*Director of the United States Patent and Trademark Office*